US006145450A

United States Patent [19]

Vatsky

[11] Patent Number: 6,145,450

[45] **Date of Patent: *Nov. 14, 2000**

[54] BURNER ASSEMBLY WITH AIR STABILIZER VANE

[75] Inventor: Joel Vatsky, West Orange, N.J.

[73] Assignee: Foster Wheeler Corporation, Clinton, N.J.

[ * ] Notice: Under 35 U.S.C. 154(b), the term of this patent shall be extended for 467 days.

[21] Appl. No.: 08/595,965

[22] Filed: Feb. 6, 1996

[51] Int. Cl.[7] ..... F23D 1/00; F23C 7/00

[52] U.S. Cl. ..... 110/265; 431/8; 431/187

[58] Field of Search ..... 110/264, 265; 431/187, 181, 8, 9, 10

[56] References Cited

U.S. PATENT DOCUMENTS

| | | | |
|---|---|---|---|
| 1,117,165 | 11/1914 | Convery . | |
| 1,535,886 | 4/1925 | Zulver | 431/187 |
| 1,566,177 | 12/1925 | Whitaker | 431/187 |
| 1,995,934 | 3/1935 | Mangold . | |
| 2,022,512 | 11/1935 | Macchi | 431/116 |
| 2,048,495 | 7/1936 | Eaton et al. | 431/187 |
| 2,271,587 | 2/1942 | Haynes . | |
| 2,480,547 | 8/1949 | Caracristi . | |
| 2,838,103 | 6/1958 | Voorheis . | |
| 2,889,871 | 6/1959 | Voorheis . | |
| 3,050,374 | 8/1962 | Burt et al. | 431/187 |
| 3,391,981 | 7/1968 | Voorheis et al. . | |
| 3,576,384 | 4/1971 | Peczeli et al. | 431/187 |
| 3,753,658 | 8/1973 | Henderson et al. | 431/116 |
| 4,348,170 | 9/1982 | Vatsky et al. . | |
| 4,400,151 | 8/1983 | Vatsky . | |
| 5,244,381 | 9/1993 | Cahlik | 431/171 |
| 5,651,320 | 7/1997 | Leisse et al. | 110/265 X |
| 5,738,021 | 4/1998 | Vatsky et al. | 110/265 X |

*Primary Examiner*—Ira S. Lazarus
*Assistant Examiner*—Ljiljana V. Ciric
*Attorney, Agent, or Firm*—Haynes and Boone, LLP

[57] ABSTRACT

A burner assembly in which an inlet is located at one end of a tubular member thereof for receiving a fuel/air mixture, and an outlet is located at the other end of the tubular member for discharging the mixture. Secondary air is directed towards the outlet and a register vanes are provided in the path of secondary air flow for regulating the quantity of air flowing through the paths. A stabilizer vane extends from the outer surface of the burner housing and is constructed and arranged to stabilize the secondary air flow without affecting the discharge of the fuel from the burner.

6 Claims, 1 Drawing Sheet

BURNER ASSEMBLY WITH AIR STABILIZER VANE

BACKGROUND OF THE INVENTION

This application relates generally to a burner assembly and more particularly to an improved burner assembly which operates in a manner to stabilize the air flow to the burner and reduce the formation of nitrogen oxides as a result of fuel combustion.

Considerable attention and efforts have recently been directed to the reduction of nitrogen oxides resulting from the combustion of fuel, and especially in connection with the use of coal in the furnace sections of relatively large installations such as vapor generators and the like. In a typical arrangement for burning coal in a vapor generator, several burners are disposed in communication with the interior of the furnace and each operates to burn a mixture of air and pulverized coal. The burners used in these arrangements are generally of the type in which a fuel air mixture is continuously injected through a nozzle so as to form a single relatively large flame, and combustion-supporting, or "secondary" air is introduced towards the burner outlet to insure complete combustion. As a result, the surface area of the flame is relatively small in comparison to its volume, and therefore the average flame temperature is relatively high. However, in the burning of coal, nitrogen oxides are formed by the fixation of atmospheric nitrogen available in the combustion supporting air, which is a function of the flame temperature. When the flame temperature exceeds 2800° F., the amount of fixed nitrogen removed from the combustion supporting air rises exponentially with increases in the temperature. This condition leads to the production of high levels of nitrogen oxides in the final combustion products, which causes severe air pollution problems.

Nitrogen oxides are also formed from the fuel bound nitrogen available in the fuel itself, which is not a direct function of the flame temperature, but is related to the quantity of available oxygen during the combustion process.

In view of the foregoing, attempts have been made to suppress the burner and flame temperatures and reduce the quantity of available oxygen during the combustion process and thus reduce the formation of nitrogen oxides. Attempted solutions have included techniques involving two-stage combustion, flue gas recirculation, the introduction of an oxygen-deficient fuel-air mixture to the burner and the breaking up of a single large flame into a plurality of smaller flames. However, although these attempts singularly may produce some beneficial results they have not resulted in a reduction of nitrogen oxides to minimum levels. Also, these attempts have often resulted in added expense in terms of increase construction costs and have lead to other related problems such as the production of soot and the like.

Other attempts to improve the overall combustion efficiency of the burners include the provision of a vane, or the like, on the outer surface of each burner housing to stabilize the flow of the secondary air towards the burner outlet and into the furnace opening in which the burner is installed. However, these vanes often cause downstream eddy currents to form which suck some of the coal discharging from the burner outlet back towards the vane and compromise the performance of the burner.

SUMMARY OF THE INVENTION

It is therefore an object of the present invention to provide a burner assembly which operates in a manner to considerably reduce the production of nitrogen oxides in the combustion of fuel without any significant increase in cost or other related problems.

It is a still further object of the present invention to provide a burner assembly of the above type in which the secondary air supply to the burner is regulated to reduce the quantity of available oxygen during the combustion process and achieve an attendant reduction in the formation of nitrogen oxides.

Another object of the present invention is to provide a burner assembly of the above type in which the secondary air is directed toward the burner outlet in two parallel paths, with register means being disposed in each path for individually controlling the flow of air through each path.

It is a more specific object of the present invention to provide a burner assembly of the above type in which a stabilizer vane is provided for the secondary air which improves the performance of the burner without any deleterious effects.

Toward the fulfillment of these and other objects, the burner assembly of the present invention includes an inlet located at one end thereof for receiving a fuel/air mixture, and an outlet located at the other end for discharging the mixture. Secondary air is directed towards the outlet in parallel paths extending around the burner, and a plurality of register vanes are disposed in each of the paths for regulating the quantity of air flowing through the paths. A stabilizer vane extends from the outer surface of the burner housing and is constructed and arranged to stabilize the secondary air flow without affecting the discharge of the fuel from the burner.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENTS

Figure 1:
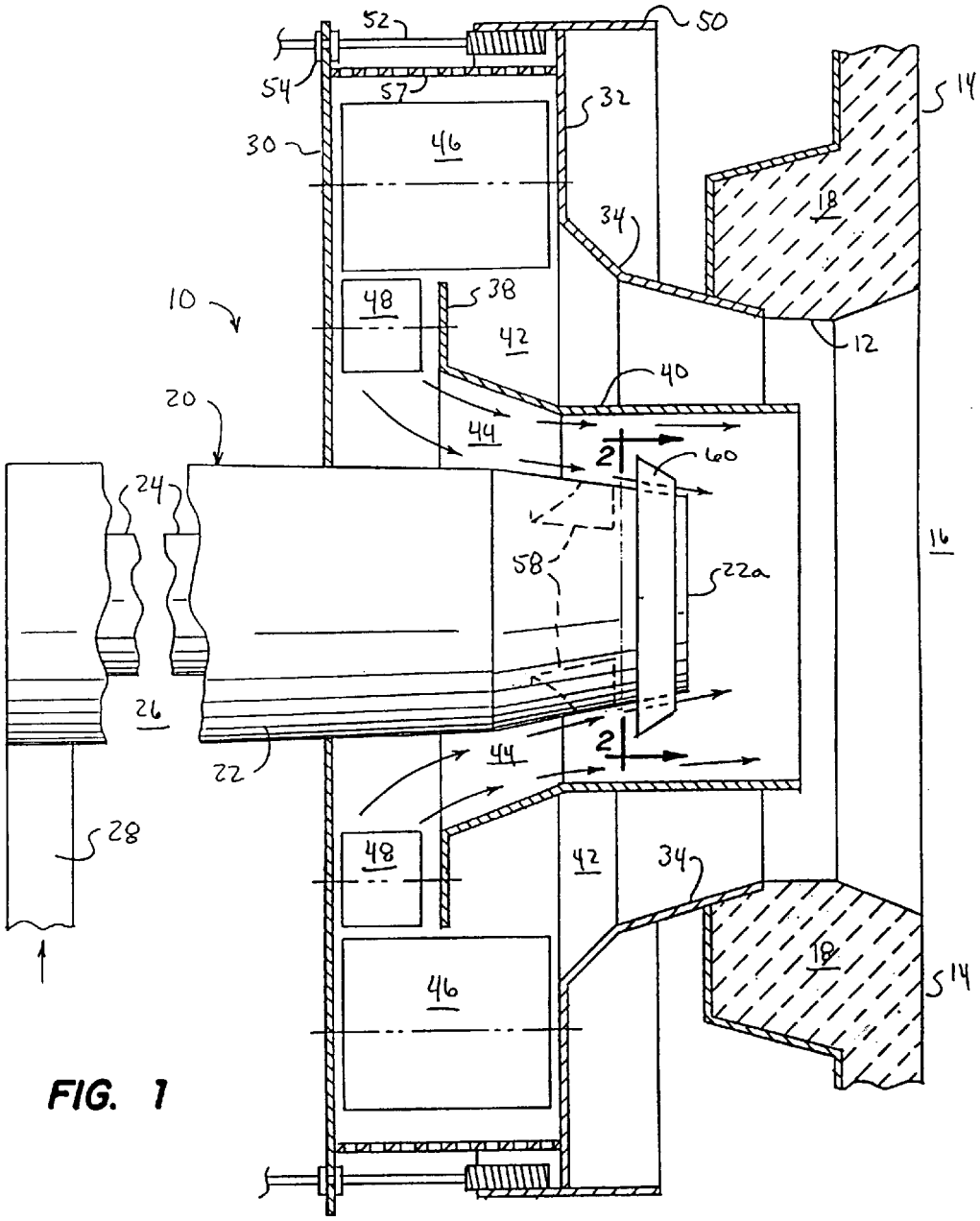
FIG. 1 is a sectional view depicting the burner assembly of the present invention.

Referring specifically to FIG. 1 of the drawings the reference numeral 10 refers in general to a burner assembly which is disposed in axial alignment with a through opening 12 formed in a front wall 14 of a conventional furnace. It is understood that the furnace includes a back wall and side walls of an appropriate configuration to define a combustion chamber 16 immediately adjacent the opening 12. Also similar openings are provided in the furnace front wall 14 for accommodating additional burner assemblies identical to the burner assembly 10. The inner surface of the wall 14 as well as the other walls of the furnace are lined with an appropriate thermal insulation material 18 and, while not specifically shown, it is understood that the combustion chamber 16 can also be lined with vertically extending boiler tubes through which a heat exchange fluid, such as water, is circulated in a conventional manner for the purposes of producing steam.

It is also understood that a vertical wall is disposed in a spaced parallel relationship with the furnace wall 14 in a direction opposite that of the furnace opening 12 along with correspondingly spaced top, bottom and side walls to form a plenum chamber, or wind box, for receiving combustion supporting air, commonly referred to as a "secondary air," in a conventional manner.

A burner 20 is provided which includes an outer barrel, or tubular member, 22 that extends over an inner tubular member 24 in a coaxial, spaced relationship thereto to define an annular passage 26 which extends towards the furnace opening 12. The end portion of the outer tubular member 22 and the corresponding end portion (not shown) of the inner tubular member 24 are tapered slightly radially inwardly toward the furnace opening 12. A tangentially disposed inlet 28 communicates with the outer tubular member 22 for introducing a mixture of primary air and entrained particulate fuel into the annular passage 26 as will be explained in further detail later.

A pair of spaced annular plates 30 and 32 extend around the burner 20, with the inner edge of the plate 30 terminating on the outer tubular member 22. A liner 34 extends from the inner edge of the plate 32 and in a general longitudinal direction relative to the outer tubular member 22 and terminates adjacent the insulation material 18 just inside the wall 14. An additional annular plate 38 extends around the member 22 in a spaced, parallel relation with the plate 30, to define an inlet for secondary air. An air divider sleeve 40 extends from the inner surface of the plate 38 and between the liner 34 and the member 22 to define two air flow passages 42 and 44.

A plurality of outer register vanes 46 are pivotally mounted between the plates 30 and 32 to control the swirl of secondary air from the wind box to the air flow passages 42 and 44. In a similar manner a plurality of inner-register vanes 48 are pivotally mounted between the plates 30 and 38 to further regulate the swirl of the secondary air passing through the annular passage 44. It is understood that although only two register vanes 46 and 48 are shown in FIG. 1, several more vanes extend in a circumferentially spaced relation to the vanes shown. Also, the pivotal mounting of the register vanes 46 and 48 may be done in any conventional manner, such as by mounting the vanes on shafts (shown schematically in FIG. 1) and journalling the shafts in proper bearings formed in the plates 30, 32 and 38. Also, the position of the vanes 46 and 48 may be adjustable by means of cranks or the like. Since these types of components are conventional they are not shown in the drawings nor will be described in any further detail.

The quantity of secondary air flow from the wind box into the register vanes 46 is controlled by movement of a sleeve 50 which is slidably disposed on the outer periphery of the plate 32 and is movable parallel to the longitudinal axis of the burner 20. An elongated worm gear 52 is provided for moving the sleeve 50 in an axial direction to and from the plate 30. Details of the worm gear 52 are fully disclosed in U.S. Pat. Nos. 4,400,151 and 5,347,937, which are assigned to the assignee of the present invention and which are hereby incorporated by reference. Since these details do not form a part of the present invention they will not be described any further.

The worm gear 52 operates to enable the quantity of combustion supporting air from the wind box passing through the air flow passages 42 and 44 to be controlled by axial displacement of the sleeve 50. A perforated air hood 57 extends between the plates 30 and 32 immediately downstream of the sleeve 50 to permit independent measurement of the air flow to the burner 20.

With reference to the burner 20, four divider blocks (two of which are shown in FIG. 1) are circumferentially spaced in the annular passage 26 in the outlet end portion of the burner to divide the mixture of particulate fuel and entrained primary received from the inlet 28 into five separate streams. Since the details of these divider blocks 58 are fully disclosed in the above-identified '151 patent they will not be described in further detail.

Figure 2:
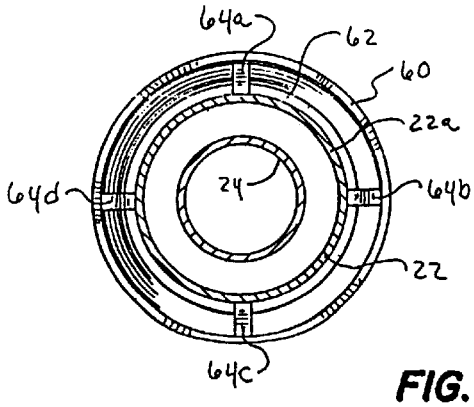
FIG. 2 is an end view of the burner assembly of FIG. 1 taken along the line 2—2 of FIG. 1.

According to a feature of the present invention, a frustoconical vane 60 extends over the outer tubular member 22. As shown in FIG. 2, the vane 60 extends in a spaced relationship to the member 22 to define an annular space 62. Four support struts 64*a*–64*d*, spaced at ninety degree intervals, extend between, and are affixed to, the outer surface of the member 22 and the inner surface of the vane 60 to support the vane over the member 22.

The vane 60 is tapered radially inwardly in a direction towards the outlet end of the nozzle 20 with its smaller diameter extending downstream from its larger diameter and slightly upstream from the end 22*a* of the outer tubular member 22. Thus, a portion of the air passing through the passage 44 impinges against the inner wall of the vane 60 which serves to direct the latter portion to and through the annular gap 62 and towards the end 22*a* of the tubular member 22. This air, along with the remaining portion of the air passing through the passage 44 and the air passing through the passage 42, mixes with the streams of combusting fuel/air mixture discharging from the member 22 and supplies sufficient oxygen to insure complete combustion of the fuel. Thus, four flame patterns are formed which then pass into and through the burner opening 12 and into the chamber 16.

In operation of the burner assembly 10, the movable sleeve 50 is adjusted during initial start up to accurately balance the air to the burner 20 with respect to the air introduced to the other burners mounted relative to the wall 14. After the initial balancing, no further movement of the sleeves 50 are needed since normal control of the secondary air to the burner 20 is accomplished by operation of the outer register vanes 46.

Pulverized coal suspended or entrained within a source of primary air is introduced into the tangential inlet 28 where it swirls through the annular chamber 26 and is split into four equally spaced streams by the blocks 58. Suitable igniters (not shown) are provided to ignite this fuel air/mixture to form four separate flame patterns, and the igniters are shut off after steady state combustion has been achieved.

Secondary air from the wind box is admitted through the perforated hood 58 and into the inlet between the plates 30 and 32. The axial and radial velocities of the secondary air is controlled by the register vanes 46 and 48 as the air passes through the air flow passages 42 and 44 and towards the furnace opening 12. A portion of the air passing through the passage 44 impinges against the inner wall of the vane 60 which serves to direct the latter portion to and through the annular gap 62 and towards the end 22*a* of the tubular member 22. This secondary air, along with the remaining portion of the secondary air passing through the passage 44 and the air passing through the passage 42, mixes with the streams of combusting fuel/air mixture discharging from the member 22 at a location just downstream of the outlet end 22*a* of the tubular member 22. The total amount of secondary air mixing with the streams of fuel/air mixtures is controlled in the manner described above to insure complete combustion of the fuel.

As a result of the foregoing, several advantages result from the burner assembly of the present invention. For example, the provision of separate register vanes 46 and 48 for the outer and inner air flow passages 42 and 44, along with the disposition of the vane 60 in the passage 44 enables secondary air distribution as well as flame shape to be independently controlled and stabilized, resulting in a significant reduction of nitrogen oxides, and a more gradual and controlled mixing of the secondary air with the mixture of fuel and primary air. Further, the provision of multiple flame patterns, each of which receives the stabilized air from the vane 60, results in a greater flame radiation, a lower average flame temperature and a shorter residence time of the gas components within the flame at a maximum temperature, all of which contribute to reduce the formation of nitric oxides.

It is understood that several variations and additions may be made to the foregoing within the scope of the invention. For example, the number of blocks 58 and therefore the number of flame patterns can vary. Also, the inner tubular member 24 and/or the blocks 58 can be omitted. Also, the burner 20 can be identical to the burner disclosed in the above-mentioned '937 patent in which an internal casting is provided which splits the fuel air mixture into a plurality of streams. Also, since the arrangement of the present invention permits the total volume of air introduced in the above manner to be less than stoichiometric, overfire air ports, or the like can be provided as needed to supply air to complete the combustion.

As will be apparent to those skilled in the art, various other changes and modifications may be made to the embodiments of the present invention without departure from the spirit and scope of the present invention as defined in the appended claims and the legal equivalent.

What is claimed is:

1. A burner assembly comprising an outer tubular member, an inner tubular member extending within the outer tubular member to define a flow passage, an inlet located at one end of the flow passage for receiving fuel into the flow passage, an outlet located at the other end of the flow passage for discharging the fuel, a splitter disposed in the flow passage for splitting up the fuel discharging from the outlet so that, upon ignition of the fuel, a plurality of flame patterns are formed, an enclosure extending around the outer tubular member and having an inlet for receiving air, the enclosure directing the air towards the outlet for mixing with the fuel discharging from the outlet to support the combustion, and a vane supported on the outer tubular member for stabilizing the flow of the air, the vane comprising a frustro-conical wall tapered radially inwardly in a direction towards the outlet so that a portion of the air impinges on the inner surface of the wall, the vane being spaced from the outer tubular member to define an annular gap therebetween so that a portion of the air passes through the annular gap and impinges against the vane before passing towards the outlet, and so that the remaining portion of the air passes from the register, over the vane and towards the outlet.

2. The assembly of claim 1 wherein the air flows in a path along the outer surface of the outer tubular member and wherein the vane is mounted to the outer surface of the outer tubular member.

3. The assembly of claim 2 wherein at least a portion of the path extends parallel to the axis of the tubular member.

4. The assembly of claim 2 wherein at least one additional path is defined in the enclosure that extends parallel in a radially-spaced relationship with the first-mention path, the air in the additional path being directed towards the outlet for mixing with the air from the first-mentioned path and with the fuel discharging from the outlet, to also support the combustion.

5. The assembly of claim 4 further comprising vanes respectively disposed in the paths for swirling the air as it passes through the paths, the latter vanes being adjustable to regulate the swirl, and a sleeve mounted on the housing and movable across the air inlet to vary the size of the air inlet and the quantity of air flow through the air inlet.

6. The assembly of claim 1 wherein the fuel inlet of the flow passage is located relative to the flow passage in a manner to introduce the fuel generally tangentially with respect to the flow passage.

* * * * *